US011898345B2

(12) United States Patent
Zuo et al.

(10) Patent No.: US 11,898,345 B2
(45) Date of Patent: Feb. 13, 2024

(54) ACOUSTIC CEILING PANEL, METHOD OF MANUFACTURE AND ACOUSTIC CEILING SYSTEM

(71) Applicant: CertainTeed Ceilings Corporation, Malvern, PA (US)

(72) Inventors: Yanjia Zuo, Marietta, GA (US); Chris L. Heikkinen, L'Anse, MI (US); John T. Madajewski, Malvern, PA (US); Phillip Evans, Littleton, MA (US); Chris W. Niemi, L'Anse, MI (US); Jeremiah L. Shaffer, L'Anse, MI (US); Isabelle Etchart Randlett, Malvern, PA (US); Robert Miller, L'Anse, MI (US); Keith C. Hong, Lititz, PA (US); Zhengzhi Zhou, Malvern, PA (US)

(73) Assignee: CertainTeed Ceilings Corporation, Malvern, PA (US)

( * ) Notice: Subject to any disclaimer, the term of this patent is extended or adjusted under 35 U.S.C. 154(b) by 212 days.

(21) Appl. No.: 17/201,784

(22) Filed: Mar. 15, 2021

(65) Prior Publication Data

US 2021/0285207 A1 Sep. 16, 2021

Related U.S. Application Data

(60) Provisional application No. 62/989,301, filed on Mar. 13, 2020.

(51) Int. Cl.
*E04B 1/86* (2006.01)
*E04B 9/00* (2006.01)
(Continued)

(52) U.S. Cl.
CPC ..... *E04B 1/86* (2013.01); *E04B 9/001* (2013.01); *E04B 9/0435* (2013.01); *E04B 9/241* (2013.01);
(Continued)

(58) Field of Classification Search
CPC ..... E04B 1/86; E04B 9/001; E04B 9/0435; E04B 9/241; E04B 9/28; E04B 2001/8461
(Continued)

(56) References Cited

U.S. PATENT DOCUMENTS 2,668,123 A * 2/1954 Copeland ..... E04B 1/86 83/866
3,074,505 A * 1/1963 Schulz ..... E04B 1/86 181/290
(Continued)

FOREIGN PATENT DOCUMENTS

WO 2019073019 A1 4/2019

*Primary Examiner* — Jeremy A Luks
(74) *Attorney, Agent, or Firm* — McDonnell Boehnen Hulbert & Berghoff LLP

(57) ABSTRACT

The present disclosure relates generally to acoustic panels, for example, suitable for use in a ceiling to control sound. The present disclosure relates more particularly to an acoustic ceiling panel including an acoustic substrate formed of a porous material having an air flow resistivity of at least 300 kPa*s/m$^2$. The acoustic substrate includes an upper face and a lower face with a pattern of perforations formed therein, where the pattern of perforations covers at least 6% of the area of the lower face. The acoustic ceiling panel also includes a backing layer disposed over the upper face of the acoustic substrate and a veil disposed over the lower face.

21 Claims, 6 Drawing Sheets

(51) Int. Cl.
*E04B 9/24* (2006.01)
*E04B 9/28* (2006.01)
*E04B 9/04* (2006.01)
*E04B 1/84* (2006.01)

(52) U.S. Cl.
CPC ..... *E04B 9/28* (2013.01); *E04B 2001/8461* (2013.01)

(58) Field of Classification Search
USPC ..... 181/293
See application file for complete search history.

(56) References Cited

U.S. PATENT DOCUMENTS 3,159,236 A * 12/1964 Akerson ..... E04B 1/86 144/365
3,174,580 A * 3/1965 Schulz ..... E04B 1/86 181/290
4,160,491 A * 7/1979 Matsumoto ..... E01F 8/0082 181/294
4,613,627 A 9/1986 Sherman et al.
5,013,405 A 5/1991 Izard
5,125,475 A * 6/1992 Ducharme ..... E04B 1/86 181/294
5,320,677 A 6/1994 Baig
5,753,871 A 5/1998 Kahara et al.
6,443,256 B1 * 9/2002 Baig ..... C04B 26/28 181/290
7,798,287 B1 9/2010 Surace et al.
8,100,226 B2 * 1/2012 Cao ..... E04B 1/86 181/292
8,371,084 B2 2/2013 Babineau, Jr.
10,464,846 B2 11/2019 Mayers et al.
2003/0041987 A1 * 3/2003 Foster ..... D21J 1/08 162/149
2005/0211500 A1 9/2005 Wendt et al.
2007/0102237 A1 * 5/2007 Baig ..... E04B 1/8409 181/290
2007/0186493 A1 * 8/2007 Baig ..... E04B 9/001 181/284
2017/0089064 A1 * 3/2017 Frantz ..... B32B 3/08
2018/0112402 A1 * 4/2018 McCartney ..... B32B 29/02
2019/0136524 A1 * 5/2019 Zhang ..... C09D 5/033
2020/0002941 A1 1/2020 Oleske et al.
2020/0027436 A1 * 1/2020 Shackleford ..... B32B 13/045
2020/0173172 A1 * 6/2020 Kragness ..... E04C 2/16
2020/0240136 A1 7/2020 Jacqus et al.

* cited by examiner

ACOUSTIC CEILING PANEL, METHOD OF MANUFACTURE AND ACOUSTIC CEILING SYSTEM

CROSS-REFERENCE TO RELATED APPLICATIONS

This application claims the benefit of priority of U.S. Provisional Patent Application No. 62/989,301, filed Mar. 13, 2020, which is hereby incorporated herein by reference in its entirety.

BACKGROUND OF THE DISCLOSURE

1. Field of the Disclosure

The present disclosure relates generally to acoustic panels, for example, suitable for use in a ceiling to control sound. The present disclosure relates more particularly to acoustic ceiling panels with a perforated substrate.

2. Technical Background

Acoustic panels are useful in a number of applications to attenuate noise. For example, an interior ceiling structure can include one or more acoustic ceiling panels positioned above the occupied space of a room or other interior part of a building. Such panels can be effective for sound reduction and/or insulation, especially in an open space, such as office area, conference room, hallway, cafeteria, auditorium, etc. There are many types of ceiling products available in the market, including gypsum ceilings, fiberglass ceilings, mineral wool ceilings, metal ceilings, wood ceilings, etc. Two important measures of acoustic performance are noise reduction coefficient (NRC), which relates to sound reduction/absorption and ceiling attenuation class (CAC), which relates to sound insulation. Most ceiling products have pros and cons in term of acoustic performance. Ceilings with high NRC performance, often yield lower CAC values. For example, fiberglass ceilings may have 90 NRC or higher but CAC of less than 25. On the other hand, gypsum ceilings may have 50 CAC but NRC of less than 40. Typically, in order to yield high NRC and CAC, more complex and/or expensive ceiling products designs are used.

The present inventors have determined that an acoustic ceiling panel that exhibits a combination of favorable NRC and CAC values while using materials that are not cost prohibitive would be attractive to both builders and consumers.

SUMMARY OF THE DISCLOSURE

In one aspect, the present disclosure provides an acoustic ceiling panel comprising:

an acoustic substrate formed of a porous material having an air flow resistivity of at least 300 kPa*s/m$^2$, the acoustic substrate including:

an upper face, and a lower face with a pattern of perforations formed therein, the pattern of perforations covering at least 6% of the area of the lower face;

a backing layer disposed over the upper face of the acoustic substrate; and a veil disposed over the lower face.

In another aspect, the disclosure provides a method of making an acoustic ceiling panel according to the disclosure, the method comprising:

adding a plurality of components of the porous material and water to a mixing tank;

mixing the plurality of components and water in the mixing tank so as to form a slurry;

dispensing the slurry onto a support surface;

drying the slurry so as to form a slab of the porous material having an upper face and a lower face;

forming perforations in the lower face of the acoustic substrate;

applying the backing layer over the upper face of the acoustic substrate; and applying the veil over the lower face of the acoustic substrate.

In another aspect, the disclosure provides an acoustic ceiling system comprising:

a ceiling support structure; and an acoustic ceiling panel according to the disclosure supported by the ceiling support structure.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have noted that conventional acoustic ceiling panels typically perform well at either sound reduction/absorption or sound insulation. The present inventors have determined that an acoustic ceiling panel that performs well in both sound absorption and insulation would be attractive to builders and consumers.

Accordingly, one aspect of the disclosure is an acoustic ceiling panel including an acoustic substrate formed of a porous material having an air flow resistivity of at least 300 kPa*s/m$^2$. The acoustic substrate includes an upper face and a lower face with a pattern of perforations formed therein, where the pattern of perforations covers at least 6% of the area of the lower face. The acoustic ceiling panel also includes a backing layer disposed over the upper face of the acoustic substrate and a veil disposed over the lower face.

Figure 1:
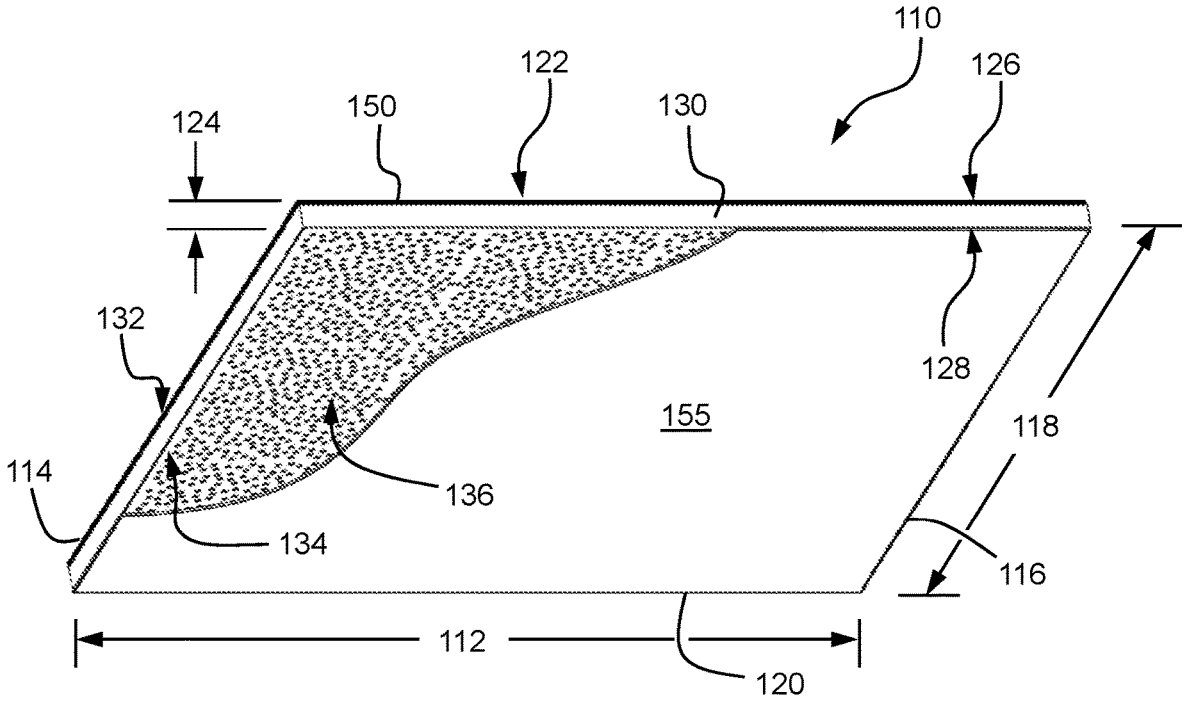
FIG. 1 is a bottom schematic perspective view of an acoustic ceiling panel according to an embodiment of the disclosure.
Figure 2:
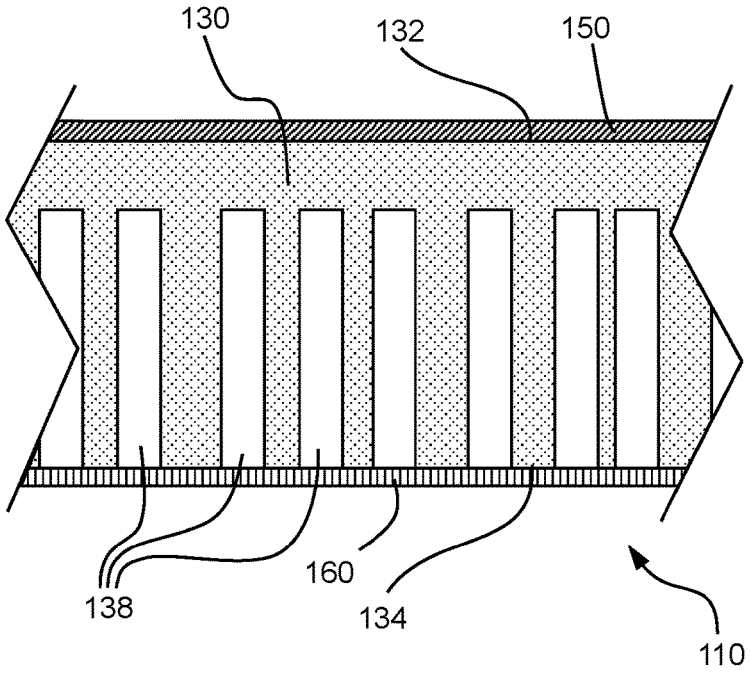
FIG. 2 is a partial cross-sectional view of the acoustic ceiling panel of FIG. 1.

Such an acoustic ceiling panel is shown in a bottom perspective view in FIG. 1 and a partial cross-section view in FIG. 2. Acoustic ceiling panel 110 has a length 112 extending from a first end 114 to a second end 116, a width 118 extending from a first side 120 to a second side 122, and a thickness 124 extending between an upper surface 126 and a lower surface 128. Acoustic ceiling panel 110 includes an acoustic substrate 130 formed of a porous material that has an air flow resistivity of at least 300 kPa*s/m$^2$. Acoustic ceiling panel 110 has an upper face 132 and a lower face 134. As shown in FIG. 1, a pattern 136 of perforations 138 is formed in the lower face 134 of acoustic substrate 130. Individual perforations 138 in the lower face 134 are shown in FIG. 2. Pattern 136 of perforations 138 covers at least 6% of the overall area of lower face 134.

Acoustic ceiling panel 110 also includes a backing layer 150 that is disposed on upper face 132 of acoustic substrate 130 and a veil 155 that is disposed on lower face 134 of acoustic substrate 130. A portion of veil 155 is removed to reveal the pattern 136 of perforations on lower face 134 of acoustic substrate 130. Each of the backing layer 150 and veil 155 are coextensive over the entire upper face 132 and lower face 134 of acoustic substrate 130, respectively.

Using an acoustic substrate that is formed of a material with an air flow resistivity of at least 300 kPa*s/m$^2$ allows the acoustic substrate to be less expensive than a substrate formed of a material with a lower air flow resistivity. For example, materials with higher air flow resistivity can be made using a higher percentage of fillers, or with less expensive fillers. Likewise, higher air flow resistivity may allow a formulation with a greater density. This higher density can result in a more robust product without taking additional measures to improve strength, such as by adding stronger binders or more expensive fibers.

Figure 3:
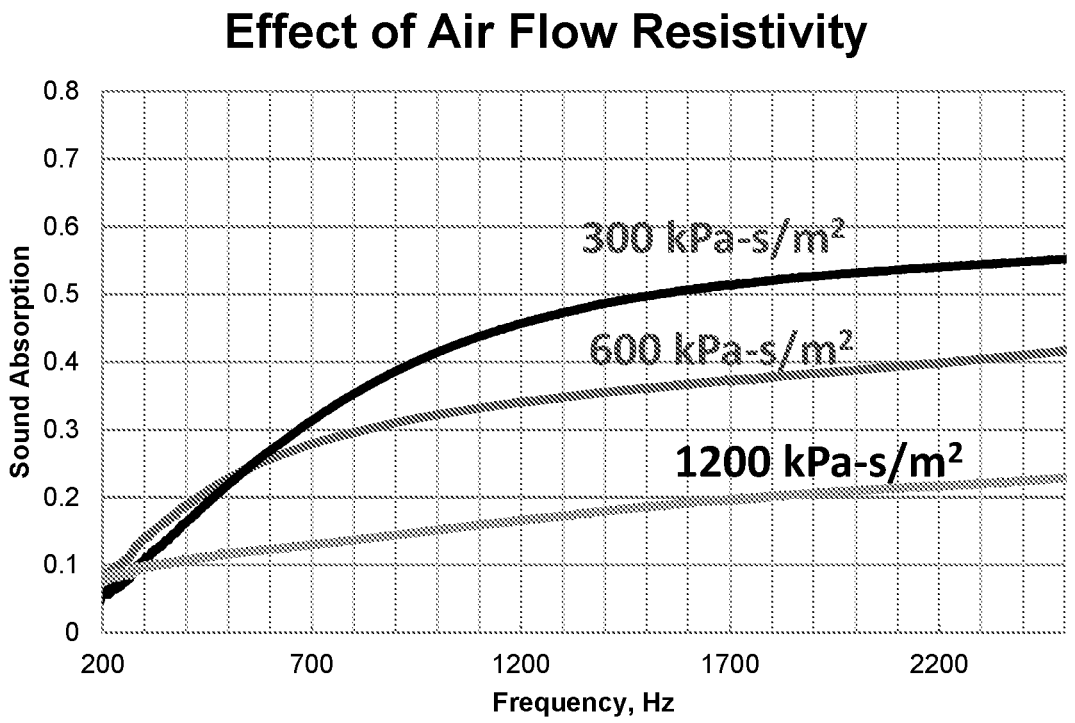
FIG. 3 is a chart showing the sound absorption over a range of frequencies for materials of three different air flow resistivities.

On the other hand, higher air flow resistivity often leads to lower sound absorption. For example, FIG. 3 shows a plot of the sound absorption over a range of frequencies for three materials that have respective air flow resistivity of 300 kPa*s/m$^2$, 600 kPa*s/m$^2$, and 1200 kPa*s/m$^2$. As illustrated by FIG. 3, except at the lowest frequencies, the lower air flow resistivity yields higher sound absorption.

To compensate for the lower sound absorption resulting from the use of a material with a higher air flow resistivity, acoustic substrates according to embodiments of the disclosure utilize perforations that cover at least 6% of the area of the lower face. The present inventors unexpectedly determined that a higher area percentage of perforations yields a higher noise reduction coefficient. For example, FIG. 4 acoustic substrates including perforations of two different pin sizes, namely pins having a size of 0.065 inches and pins having a size of 0.095 inches, have sound absorption values with a strong dependence on the percentage of area that is perforated. In particular, a higher percentage of area that is perforated yields higher sound absorption (NRC).

The inventors also surprisingly determined that the overall percentage area that is perforated had a much larger influence on sound absorption (NRC) than individual pin size. Accordingly, by providing the acoustic substrate with an overall percentage area that is perforated of at least 6%, reductions in sound absorption that would otherwise result from higher air flow resistivity of the material of the acoustic substrate can be avoided thereby allowing the production of inexpensive acoustic ceiling panels with excellent performance characteristics. The current state-of-the-art understanding is that the pin size has intrinsic importance, i.e., that having many small diameter pins is better than fewer larger diameter pins with the same total area. This past understanding discourages the production of panels with larger overall perforated area because it requires the use of a die with a greater number of pins, which may be expensive to manufacture. The inventors' determination that performance can be at least partially attributed to overall perforated area percentage promotes the use of larger perforation pins in order to achieve greater overall perforated area, which may be accomplished without significant cost increases.

In certain embodiments of the acoustic ceiling panel as otherwise described herein, the air flow resistivity of the porous material is no more than 600 kPa*s/m$^2$, e.g., no more than 500 kPa*s/m$^2$, e.g., no more than 450 kPa*s/m$^2$. Acoustic ceiling panels that include acoustic substrates formed from material with an air flow resistivity above 300 kPa*s/m$^2$ but below the aforementioned values provides improved sound absorption characteristics.

Figure 4:
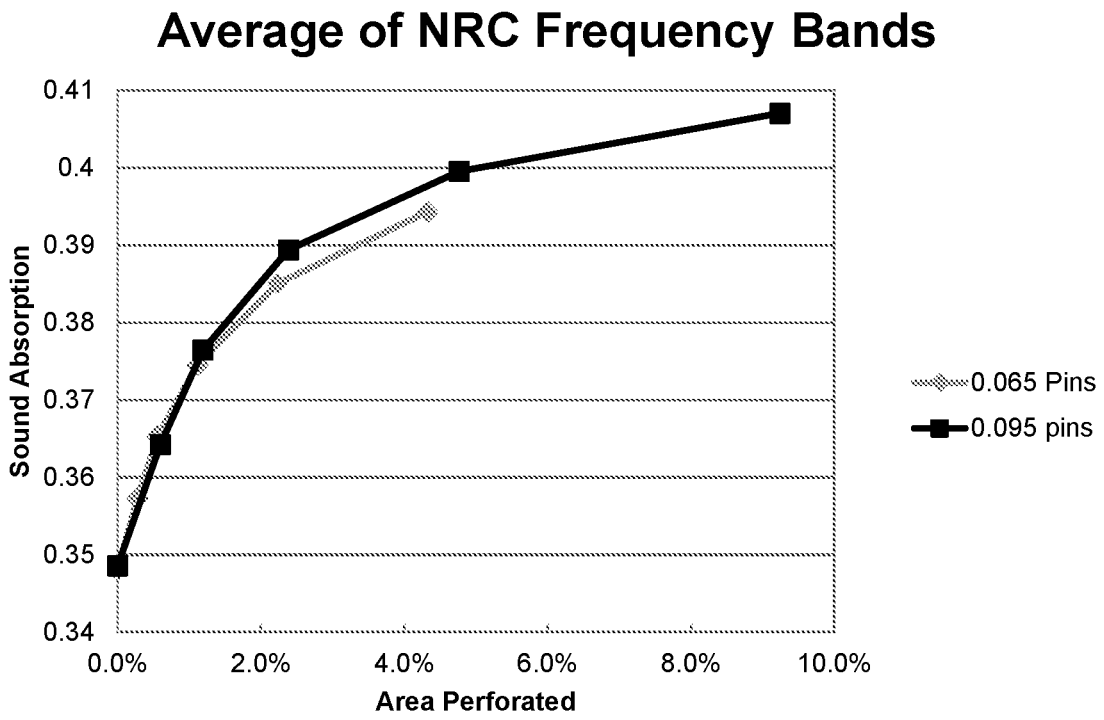
FIG. 4 is a chart showing the sound absorption over a range of different percentages of area that is perforated in an acoustic substrate.

In certain embodiments of the acoustic ceiling panel as otherwise described herein, the pattern of perforations cover no more than 25% of the area of the lower face, e.g., no more than 20% of the area of the lower face, e.g., no more than 15% of the area of the lower face. As illustrated in FIG. 4, the gains in sound absorption that are made by increasing the percentage area that is perforated begin to level off above 6%, such that further increases in the percentage area that is perforated yields diminishing returns. On the other hand, increasing the total percentage of the acoustic substrate lower face that is perforated can reduce the structural integrity of the acoustic substrate and the acoustic ceiling panel as a whole. Therefore, there is a range of percentages of area that is perforated that produces desirable sound absorption without having a substantial impact on the structural integrity of the acoustic ceiling panel.

In certain embodiments of the acoustic ceiling panel as otherwise described herein, the acoustic substrate has a noise reduction coefficient (NRC) of at least 0.4, e.g., at least 0.5, e.g., at least 0.7, e.g., at least 0.8, e.g., at least 0.85.

Further, in certain embodiments of the acoustic ceiling panel as otherwise described herein, the acoustic substrate has a ceiling attenuation class (CAC) of at least 25, e.g., at least 30, e.g., at least 40. Such high ceiling attenuation class values are attained, in part, by the backing layer of the acoustic ceiling panel, which aids in limiting sound transmission through the panel.

In some embodiments, the perforations all have the same shape. For example, in some embodiments the perforations are all circular or are all the same polygonal shape, such as a hexagon. In other embodiments the perforations have different shapes. Further, in some embodiments the perforations are irregularly shaped, such as fissure-type perforations.

In some embodiments the perforations have a substantially constant cross section in the depth direction. In other embodiments at least some of the perforations are tapered. For example, in some embodiments at least some of the perforations taper inward toward the closed end of the perforation. Likewise, in some embodiments at least some of the perforations taper outward toward the closed end of the perforation. Moreover, in some embodiments the depth of the perforations have a rounded shape, similar to a crater.

In certain embodiments of the acoustic ceiling panel as otherwise described herein, the average size of the perforations is at least 0.02 inches, e.g., at least 0.04 inches, e.g., at least 0.05 inches. Further, in some embodiments, the average size of the perforations is no more than 0.25 inches, e.g., no more than 0.2 inches, e.g., no more than 0.12 inches. For example, in some embodiments, the average size of the perforations is in a range from 0.02 inches to 0.25 inches, e.g., from 0.04 inches to 0.2 inches, e.g., from 0.05 inches to 0.12 inches. The perforation "size," as used herein, refers to a width across a cross section along the depth of the perforation. In particular, the term size refers to the length of a line that extends across a cross section of the perforation and passes through the middle of the perforation. For example, for a round perforation, the perforation size, as the term is used herein, is measured by the diameter of the perforation. Similarly, if the perforation is polygonal, the perforation size is measured across the central width of the polygonal cross-sectional shape. Moreover, if the perforation is tapered, the perforation size is measured at the opening of the perforation, i.e., at the lower face. Further, if the perforation has an irregular shape the perforation size is the average of the largest distance across the perforation opening that passes through the middle of the perforation and the smallest distance across the perforation opening that passes through the middle of the perforation.

In some embodiments, the perforations of the perforation pattern are all substantially the same size. For example, in some embodiments, 95% of the perforations vary by no more than 5% from the average perforation size. In other embodiments, the perforations of the perforation pattern vary in size. For example, in some embodiments, the sizes of the perforations fall within a range of values. In particular, in some embodiments, 95% of the perforations in the perforation pattern are within a range 0.02 inches to 0.25 inches, e.g., from 0.04 inches to 0.2 inches, e.g., from 0.05 inches to 0.12 inches.

In certain embodiments of the acoustic ceiling panel as otherwise described herein, the average depth of the perforations is at least 40% of the thickness of the acoustic substrate, e.g., at least 50%, e.g., at least 60%. Likewise, in some embodiments, the average depth of the perforations is no more than 90% of the thickness of the acoustic substrate, e.g., no more than 80%, e.g., no more than 70%. For example, in some embodiments, the average depth of the perforations is in a range from 40% of the thickness of the acoustic substrate to 90% of the thickness of the acoustic substrate, e.g., from 50% of the thickness of the acoustic substrate to 80% of the thickness of the acoustic substrate, e.g., from 60% of the thickness of the acoustic substrate to 70% of the thickness of the acoustic substrate.

Similarly, in certain embodiments of the acoustic ceiling panel as otherwise described herein, the average depth of the perforations is at least 0.1 inches, e.g., at least 0.25 inches mm, e.g., at least 0.3 inches. Further, in some embodiments, the average depth of the perforations is no more than 2 inches, e.g., no more than 1.5 inches, e.g., no more than 1 inch. In some embodiments, the depth perforations of the perforation pattern are all have substantially the same depth. For example, in some embodiments, 95% of the perforations vary in depth by no more than 5% from the average. In other embodiments, the perforations of the perforation pattern have varying depth. For example, in some embodiments, the depths of the perforations fall within a range of values. In particular, in some embodiments, 95% of the perforations in the perforation pattern have a depth within a range 0.1 inches to 2.0 inches, e.g., from 0.25 inches to 1.5 inches, e.g., from 0.3 inches to 1.0 inch.

In certain embodiments of the acoustic ceiling panel as otherwise described herein, the perforation pattern is a randomized pattern. For example, perforation pattern 136 in acoustic substrate 130 includes perforations 138 arranged in a randomized pattern on lower face 134 of acoustic substrate 130. The term randomized pattern, as used herein, includes perforations patterns with groups of at least 20 perforations that are positioned at varying distances from their closest neighbors, and not in a geometric array. In some embodiments, the entire perforation pattern of the acoustic ceiling surface is random. In other embodiments, repeating sections of the pattern are random. In other words, in some embodiments a group of perforations within a portion of the lower face of the acoustic substrate is random, but the random group repeats across the entirety of the lower face.

Figure 5:
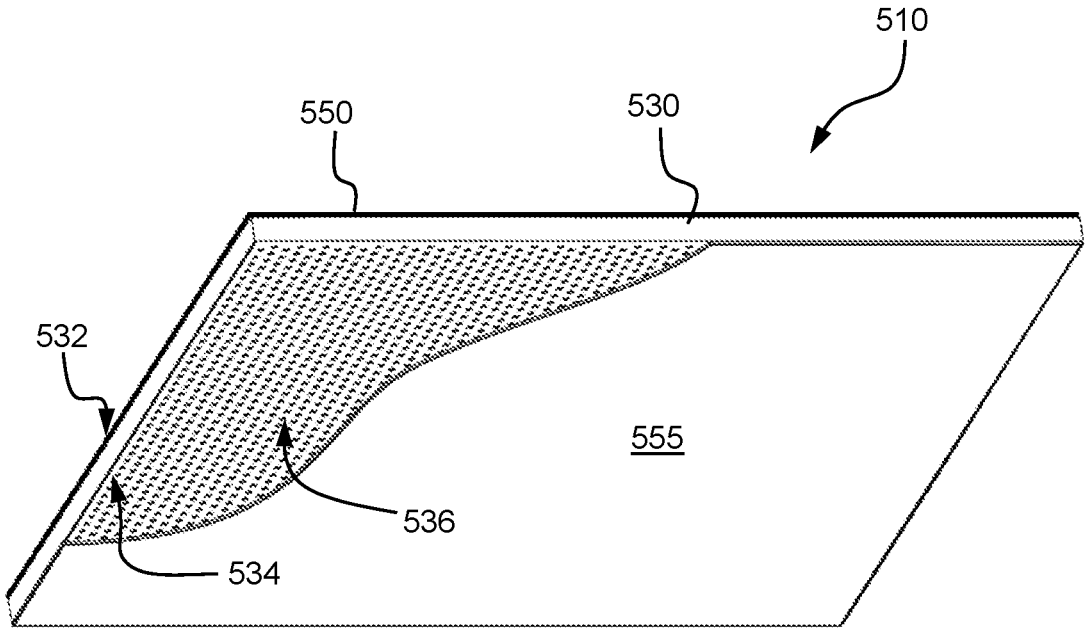
FIG. 5 is a bottom schematic perspective view of an acoustic ceiling panel according to another embodiment of the disclosure.

On the other hand, in certain embodiments of the acoustic ceiling panel as otherwise described herein, the perforation pattern is a geometric array. An acoustic ceiling panel including such a perforation pattern is shown in FIG. 5. Acoustic ceiling panel 510 includes an acoustic substrate 530 with an upper face 532 and a lower face 534. A backing layer 550 is disposed over the upper face 532 and a veil 555 is disposed over lower face 534. The lower face 534 of acoustic substrate 530 has a perforation pattern 536 in the form of a geometric array. In particular, the perforations in perforation pattern 536 are arranged in a grid with hexagonal packing. In other embodiments, the perforations are arranged in another geometric array, such as a square or rectangular grid. Other arrays are also possible.

In certain embodiments of the acoustic ceiling panel as otherwise described herein, the porous material includes a fibrous material. For example, in some embodiments, the acoustic ceiling panel includes a mineral wool, for example formed of glass, slag, or stone. Further, in some embodiments, the acoustic substrate includes polymer fibers, such as PET or polyester. Further still, in some embodiments, the acoustic substrate includes cellulose fibers, for example paper, wood pulp, or plant fibers, or combinations thereof. Moreover, some embodiments of the acoustic substrate include combinations of the aforementioned fibrous materials. In some embodiments, the fibrous material is included in the porous material forming the acoustic substrate in an amount ranging from 50% to 90% based on the total dry weight of the acoustic substrate, e.g., from 60% to 95%, e.g., from 70% to 85%.

In certain embodiments of the acoustic ceiling panel as otherwise described herein, the porous material includes a filler. Examples of fillers used in the porous material of the acoustic substrate include kaolin clay, clay, gypsum, or limestone. Further, in some embodiments, the porous material includes a porous filler. Examples of porous fillers used in the porous material of the acoustic substrate include perlite, vermiculite, hollow glass beads, or polymer beads, such as polystyrene beads. In some embodiments, the filler is included in the porous material forming the acoustic substrate in an amount ranging from 1% to 25% based on the total dry weight of the acoustic substrate, e.g., from 5% to 15%.

In certain embodiments of the acoustic ceiling panel as otherwise described herein, the porous material includes a binder. Examples of binders used in the porous material of the acoustic substrate include starch, latex, and phenolic resin. In some embodiments, the binder is included in the porous material forming the acoustic substrate in an amount ranging from 1% to 25% based on the total dry weight of the acoustic substrate, e.g., from 5% to 15%.

In certain embodiments of the acoustic ceiling panel as otherwise described herein, the porous material of the acoustic substrate has a density of at least 2 $lb/ft^3$, e.g., at least 6 $lb/ft^3$, e.g., at least 8 $lb/ft^3$, e.g., at least 10 $lb/ft^3$. In some embodiments, the porous material of the acoustic substrate has a density no greater than 20 $lb/ft^3$, e.g., no greater than 16 $lb/ft^3$, e.g., no greater than 15 $lb/ft^3$. For example, in some embodiments, the porous material of the acoustic substrate has a density in a range from 2 $lb/ft^3$ to 20 $lb/ft^3$, e.g., from 8 $lb/ft^3$ to 16 $lb/ft^3$, e.g., from 10 $lb/ft^3$ to 15 $lb/ft^3$.

In certain embodiments of the acoustic ceiling panel as otherwise described herein, the porous material has a porosity of at least 0.25, e.g., at least 0.6, e.g. at least 0.8. Higher porosity of the acoustic substrate can result in a lower weight of the acoustic ceiling panel overall. On the other hand, higher porosity can also impact the structural integrity and/or complexity of manufacturing the acoustic substrate.

In certain embodiments of the acoustic ceiling panel as otherwise described herein, the acoustic substrate has a thickness of at least ¼ inch, e.g., at least ½ inch, e.g., at least ¾ inch. Further, in some embodiments the acoustic substrate of the acoustic ceiling panel has a thickness of no more than 2 inches, e.g., no more than 1.5 inches, e.g., no more than 1 inch. For example, in some embodiments, the acoustic substrate of the acoustic ceiling panel has a thickness in a range from ¼ inch to 2 inches, e.g., from ½ inch to 1.5 inches, e.g., from ¾ inch to 1 inch. In other embodiments, the acoustic substrate of the acoustic ceiling panel has a thickness of about 1 inch. A smaller thickness of the acoustic substrate can result in a lighter product. On the other hand, a thicker acoustic substrate can yield better acoustic performance. The present invention provides desirable acoustic performance in a relatively thin acoustic ceiling panel.

In certain embodiments of the acoustic ceiling panel as otherwise described herein, the backing layer includes a binder. For example, in some embodiments the backing layer includes an acrylic binder, starch, polyvinyl alcohol, a latex, an epoxy resin, a combination thereof or another binder.

In certain embodiments of the acoustic ceiling panel as otherwise described herein, the backing layer includes a filler. For example, in some embodiments, the backing layer includes calcium carbonate, limestone, perlite, or vermiculate, as well as other fillers.

In certain embodiments of the acoustic ceiling panel as otherwise described herein, the veil includes an air permeable material. For example, in some embodiments, the veil is formed of a fiberglass mat. In other embodiments, the veil is formed by an air permeable polymer sheet, such as a sheet including polyester or PET. In some embodiments, the veil is formed of a woven or non-woven fibrous material.

In certain embodiments of the acoustic ceiling panel as otherwise described herein, the acoustic ceiling panel has a length of at least 12 inches, e.g., at least 18 inches, e.g., at least 24 inches. In some embodiments, the acoustic ceiling panel has a length of no more than 20 feet, e.g., no more than 10 feet, e.g., no more than 5 feet. For example, in some embodiments, the length of the acoustic ceiling panel is in a range from 1 foot to 20 feet, e.g., 1.5 feet to 10 feet, e.g., 2 feet to 5 feet.

In certain embodiments of the acoustic ceiling panel as otherwise described herein, the acoustic ceiling panel has a width of at least 12 inches, e.g., at least 18 inches, e.g., at least 24 inches. In some embodiments, the acoustic ceiling panel has a width of no more than 10 feet, e.g., no more than 8 feet, e.g., no more than 4 feet. For example, in some embodiments, the width of the acoustic ceiling panel is in a range from 1 foot to 10 feet, e.g., 1.5 feet to 8 feet, e.g., 2 feet to 4 feet.

In certain embodiments of the acoustic ceiling panel as otherwise described herein, the acoustic ceiling panel is planar. For example, acoustic ceiling panel 110, shown in FIG. 1 is a planar rectangle. Such an embodiment is well suited for being held in a ceiling grid. In other embodiments, the ceiling panel has a curved shape. For example, in some embodiments, the upper and lower faces of the acoustic substrate are curved so as to form a three-dimensional ceiling panel. Such a ceiling panel may be hung from a ceiling support structure by wire. Likewise, planar ceiling panels may also be hung from a ceiling support structure.

In another aspect, the disclosure provides a method of making an acoustic ceiling panel according to the disclosure. The method includes adding water and a plurality of components of a porous material of an acoustic substrate to a mixing tank. The plurality of components and water are then mixed in the mixing tank so as to form a slurry. Subsequently, the slurry is dispensed onto a support surface. The slurry is then dried so as to form a slab of the porous material of an acoustic substrate that has a first face and a second face. Perforations are then formed in the second face of the acoustic substrate. The method also includes applying a backing layer over the first face of the acoustic substrate and applying a veil over the second face of the acoustic substrate.

Figure 6A:
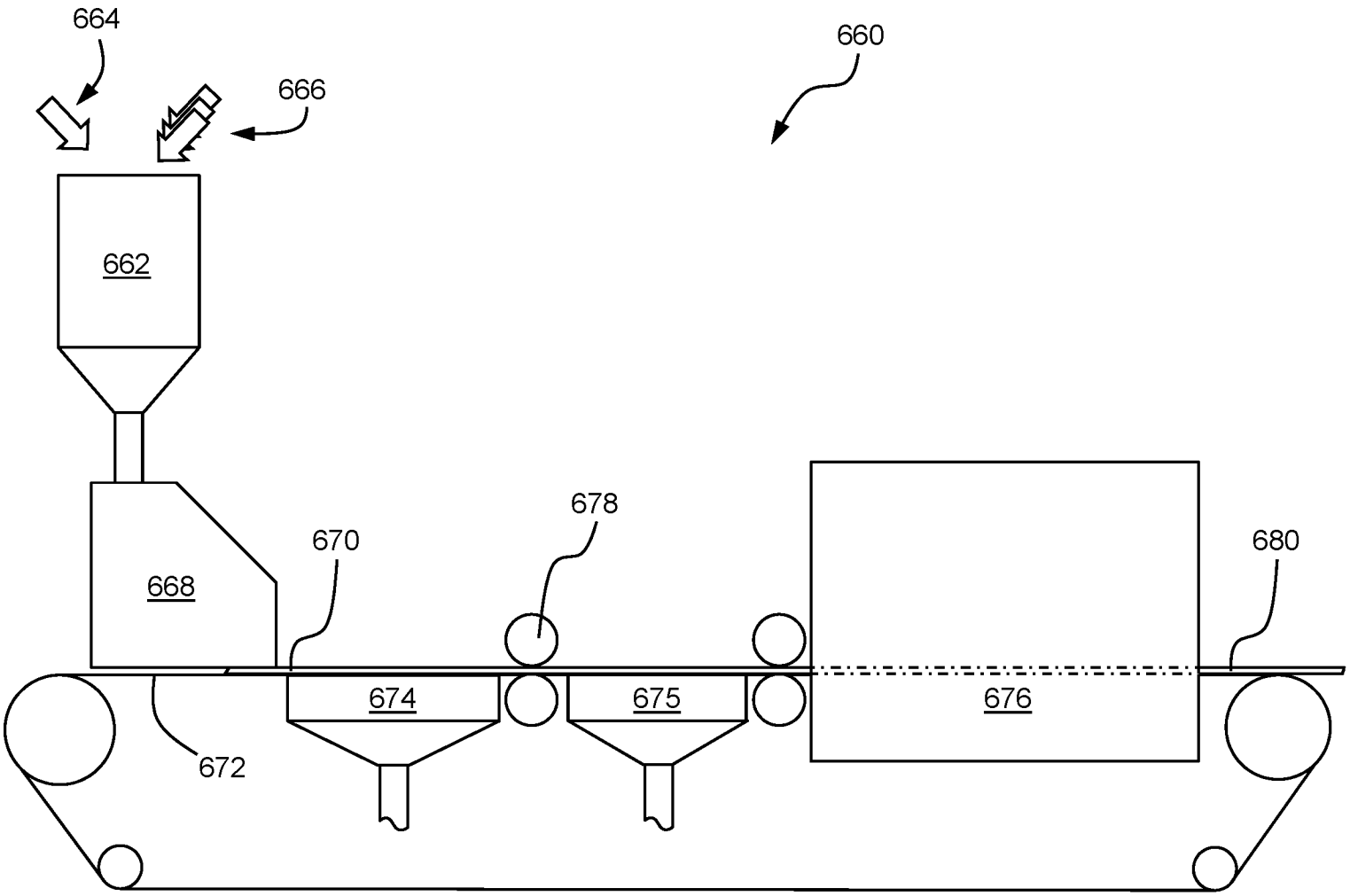
FIG. 6A is a schematic side view of a portion of a system for making an acoustic ceiling panel according to an embodiment of the disclosure.
Figure 6B:
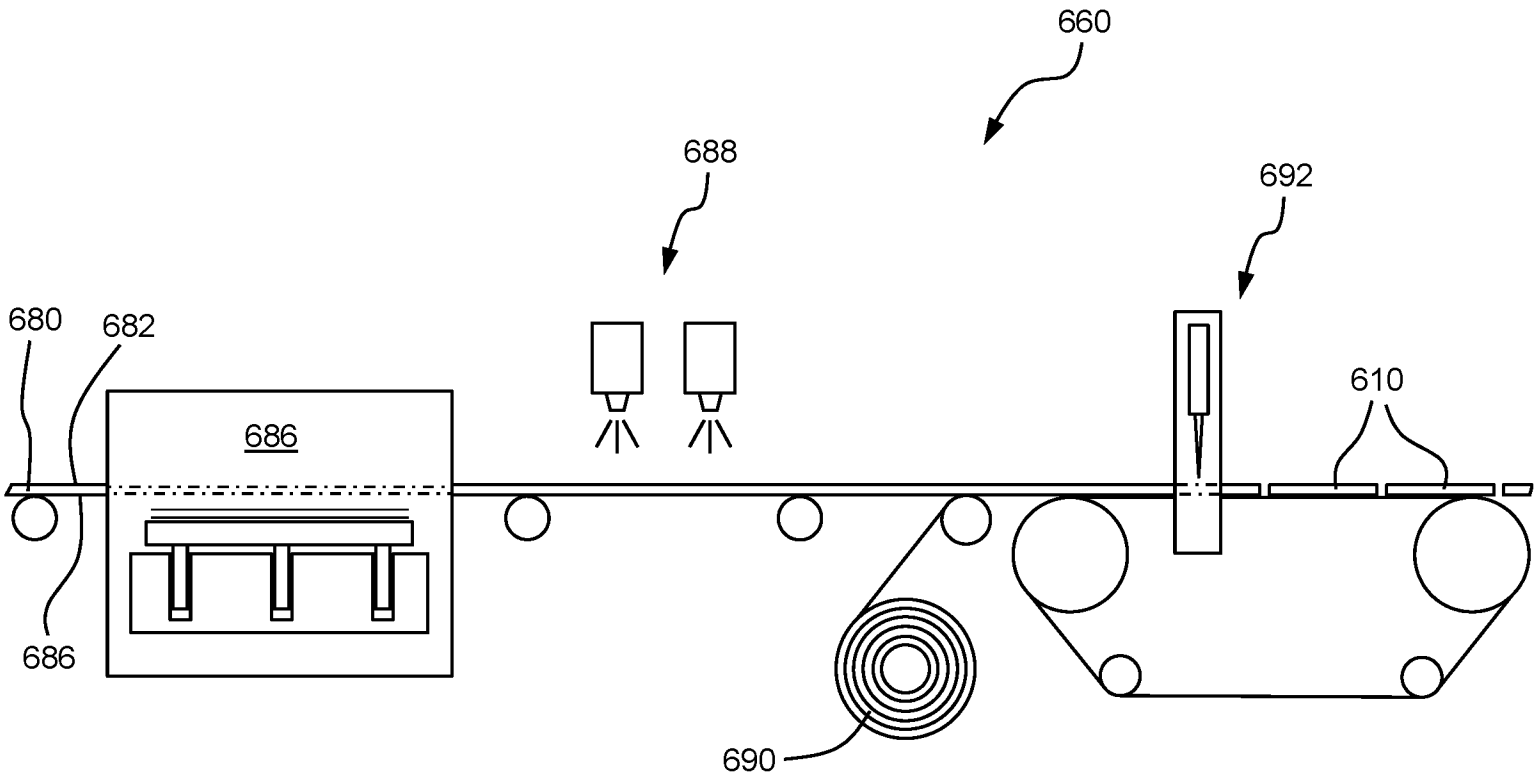
FIG. 6B is a schematic side view of another portion of a system for making an acoustic ceiling panel according to an embodiment of the disclosure.

Such a method is shown in FIGS. 6A and 6B. As shown in FIG. 6A, manufacturing system 660 includes a mixing tank 662 that receives water 664 and various components 666 of a porous material of an acoustic substrate. The water 664 and components 666 are mixed in mixing tank 662 to form a slurry 670, which is dispensed by a head box 668 onto a support surface 672. The slurry 670 is then dried at several stages 674, 675, 676 as explained in more detail below, and pressed between rollers 678 to form a slab 680 of the porous material that has a first face 682 and a second face 684.

As shown in FIG. 6B, the slab 680 is then processed to form acoustic ceiling tiles. For example, second face 684 of slab 680 is perforated by a perforation machine 686 and the first face 682 is covered with the backing layer by a dispenser 688. Furthermore, the second face 684 is also covered with the veil that is unwound from a roll 690. Acoustic ceiling tiles 610 are then cut from the slab 680 using a cutting machine 692. In other embodiments, the order of operations that produce acoustic ceiling tiles from the slab is different. For example, in some embodiments, the slab is cut into segments before the second face is perforated or the backing layer and veil are applied. Further, in some embodiments, the veil is applied to the second face before the backing layer is applied to the first face. Other orders of these operations are also possible. Moreover, in some embodiments, one or more of the operations is carried out simultaneously or in a sequentially overlapping manner. Further, while the system in FIG. 6B shows the first face facing upward and the second face facing downward, in other embodiments, the system operates with the first face of the slab facing downward and the second face facing upward.

In certain embodiments of the method as otherwise described herein, a solid percentage of the slurry is at least 2%, e.g., at least 3%, e.g., at least 4%, by weight. In some embodiments, a solid percentage of the slurry is no more than 10%, e.g., no more than 8%, e.g., no more than 5%. For example, in some embodiments, the solid percentage of the slurry is in a range from 2% to 10%, e.g., from 3% to 8%, e.g., from 4% to 5%. For example, the proportions of water 664 and components 666 that are mixed in mixing tank 662 yields a slurry 670 with a solid percentage in a range from 4% to 5%.

In certain embodiments of the method as otherwise described herein, a solid percentage of the water is no more than 0.5 weight %, e.g., no more than 0.3 weight %. For example, in some embodiments, the water that is added to the mixing tank is recycled from the acoustic ceiling panel manufacturing process or another process and includes solids therein. Further, in some embodiments, the recycled water is filtered to regulate the weight percentage of solids in the water.

In certain embodiments of the method as otherwise described herein, drying the slurry includes water removal by gravity. For example, the support surface 672 of manufacturing system 660 is in the form of a screen and water is drained from the slurry in section 674 through holes in the screen.

In certain embodiments of the method as otherwise described herein, drying the slurry includes water removal by vacuum suction. For example, manufacturing system 660 includes a vacuum section 675 in which additional water is removed from the slurry through the support surface 672, i.e., through the screen, by the forming of a vacuum below the screen.

In certain embodiments of the method as otherwise described herein, drying the slurry includes heating the slurry in a dryer. For example, manufacturing system 660 includes a heated dryer 676 in the form of a convection oven that further removes water from the slurry to form slab 680.

In certain embodiments of the method as otherwise described herein, the perforations are formed by inserting pins into the second face of the acoustic substrate. For example, perforation machine 686 includes a plate that is covered with a pattern of pins. During operation, the plate is pressed against the second face of the acoustic substrate so as to form the perforations with the pattern of pins. In other embodiments, the perforations are formed by a plurality of pins that are moved over the surface and inserted into the second face to produce perforations and various positions. Still, in other embodiments, the perforations are formed by another method.

In certain embodiments of the method as otherwise described herein, the backing layer is applied as a coating. For example, dispenser 688 sprays a coating on the first face 682 of slab 680 that dries to form the backing layer. In other embodiments, the dispenser is in the form of a film that is applied to first face of the slab. For example, in some embodiments, the backing layer is unwound from a roll and adhered to the first face of the slab using an adhesive.

In some embodiments, the veil is unwound from a roll and secured to the second face of the slab using an adhesive. In other embodiments, the veil is applied by another method, such as by a layer of paint or another coating. Further, in some embodiments, the acoustic ceiling panels are produced without a veil.

Figure 7:
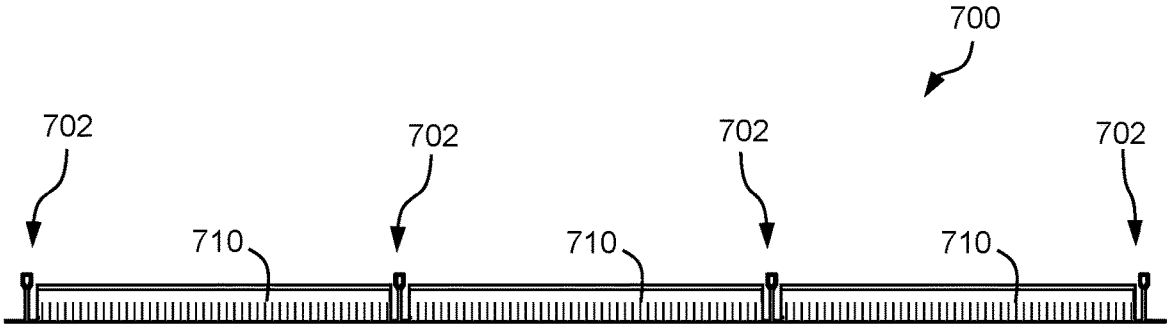
FIG. 7 is schematic side view of an acoustic ceiling system according to an embodiment of the disclosure.
Figure 8:
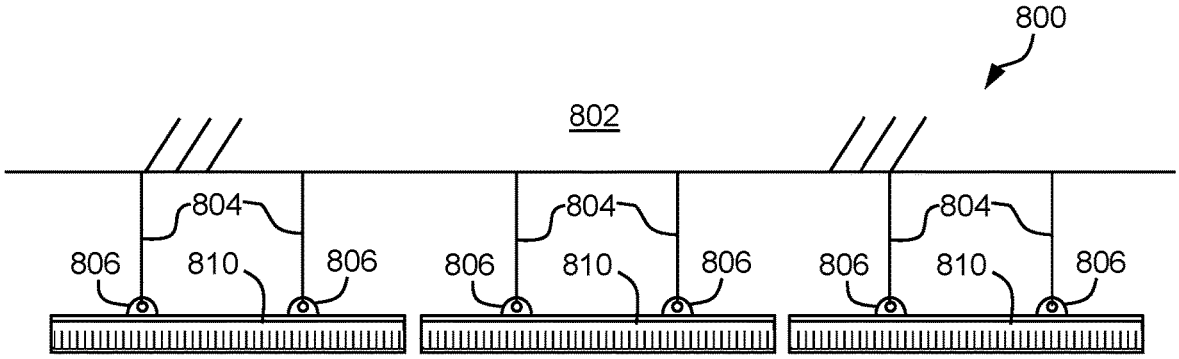
FIG. 8 is a schematic side view of another acoustic ceiling system according to an embodiment of the disclosure.

In another aspect, the disclosure provides an acoustic ceiling system including a ceiling support structure and an acoustic ceiling panel according to the disclosure supported by the ceiling support structure. Such an acoustic ceiling system is shown in FIG. 7. Acoustic ceiling system 700 includes several acoustic ceiling panels 710 supported by a ceiling support structure 702. In accordance with the disclosure, each of the acoustic ceiling panels 710 includes an acoustic substrate formed of a porous material having an air flow resistivity of at least 300 kPa*s/m$^2$. The acoustic substrate includes an upper face and a lower face with a pattern of perforations formed therein, where the pattern of perforations covers at least 6% of the area of the lower face. Each of the acoustic ceiling panels also includes a backing layer disposed over the upper face of the acoustic substrate and a veil disposed over the lower face.

In certain embodiments of the acoustic ceiling system as otherwise described herein, the ceiling support structure includes a ceiling grid. For example, ceiling support structure 702 of acoustic ceiling system 700 includes a plurality of grid members that form a ceiling grid. The grid members of ceiling support structure 702 are in the form of T-bar grid members, and the acoustic ceiling panels 710 are supported by the flanges of the grid members. In other embodiments, the ceiling support structure includes a ceiling grid formed of other types of grid members.

In certain embodiments of the acoustic ceiling system as otherwise described herein, the acoustic ceiling panel is hung from the ceiling support structure. For example, in acoustic ceiling system 800, each of the acoustic ceiling panels 810 is hung from ceiling support structure 802 by wire 804. Wire 804 is secured to acoustic ceiling panel 810 using a mounted fastener 806. In other embodiments, the wire is secured to the acoustic ceiling panel in another manner, for example, on a fastener disposed on a perimeter frame of the acoustic ceiling panel.

In certain embodiments of the acoustic ceiling system as otherwise described herein, the acoustic ceiling panel is one of an array of acoustic ceiling panels in the acoustic ceiling system. For example, acoustic ceiling system 700 includes an array of acoustic ceiling panels 710 supported by the ceiling grid of ceiling support structure 702. FIG. 7 shows a section of one row in a plurality of rows the acoustic ceiling panels 710 of system 700.

In certain embodiments of the acoustic ceiling system as otherwise described herein, the acoustic ceiling panels are parallel. Further, in some embodiments, the acoustic ceiling panels are coplanar. For example, the acoustic ceiling panels 710 of acoustic ceiling system 700 are all parallel and lie in the same plane. Accordingly, acoustic ceiling system 700 forms a continuous planar surface that forms a ceiling.

In other embodiments, the acoustic ceiling panels are supported by the ceiling support structure at various angles and heights. For example, in some embodiments, the acoustic ceiling panels are hung by wires of various length to position the panels at various heights and angles. In other embodiments the acoustic ceiling panels are supported by a ceiling grid that changes in height and/or angle.

Additional aspects of the disclosure are described by the following enumerated embodiments, which can be combined in any number and in any combination not technically or logically inconsistent.

Embodiment 1. An acoustic ceiling panel comprising:
- an acoustic substrate formed of a porous material having an air flow resistivity of at least 300 kPa*s/m$^2$, the acoustic substrate including:
  - an upper face, and
  - a lower face with a pattern of perforations formed therein, the pattern of perforations covering at least 6% of the area of the lower face;
- a backing layer disposed over the upper face of the acoustic substrate; and
- a veil disposed over the lower face.

Embodiment 2. The acoustic ceiling panel according to embodiment 1, wherein the air flow resistivity of the porous material is no more than 600 kPa*s/m$^2$, e.g., no more than 500 kPa*s/m$^2$, e.g., no more than 450 kPa*s/m$^2$.

Embodiment 3. The acoustic ceiling panel according to embodiment 1 or embodiment 2, wherein the pattern of perforations covers no more than 25% of the area of the lower face, e.g., no more than 20% of the area of the lower face, e.g., no more than 15% of the area of the lower face.

Embodiment 4. The acoustic ceiling panel according to any of embodiments 1 to 3, wherein the acoustic substrate has a noise reduction coefficient (NRC) of at least 0.4, e.g., at least 0.5, e.g., at least 0.7, e.g., at least 0.8, e.g., at least 0.85.

Embodiment 5. The acoustic ceiling panel according to any of embodiments 1 to 4, wherein the acoustic substrate has a ceiling attenuation class (CAC) of at least 25, e.g., at least 30, e.g., at least 40.

Embodiment 6. The acoustic ceiling panel according to any of embodiments 1 to 7, wherein the average size of the perforations is at least 0.25 mm, e.g., at least 0.5 mm.

Embodiment 7. The acoustic ceiling panel according to any of embodiments 1 to 6, wherein the average size of the perforations is no more than 5 mm, e.g., no more than 4 mm, e.g., no more than 3 mm.

Embodiment 8. The acoustic ceiling panel according to any of embodiments 1 to 7, wherein the average depth of the perforations is at least 40% of the thickness of the acoustic substrate, e.g., at least 50%, e.g., at least 60%.

Embodiment 9. The acoustic ceiling panel according to any of embodiments 1 to 8, wherein the average depth of the perforations is no more than 90% of the thickness of the acoustic substrate, e.g., no more than 80%, e.g., no more than 70%.

Embodiment 10. The acoustic ceiling panel according to any of embodiments 1 to 7, wherein the average depth of the perforations is at least 0.1 inches, e.g., at least 0.25 inches, e.g., at least 0.3 inches.

Embodiment 11. The acoustic ceiling panel according to any of embodiments 1 to 7 or 10, wherein the average depth of the perforations is no more than 2 inches, e.g., no more than 1.5 inches, e.g., no more than 1 inch.

Embodiment 12. The acoustic ceiling panel according to any of embodiments 1 to 11, wherein the perforation pattern comprises a randomized pattern.

Embodiment 13. The acoustic ceiling panel according to any of embodiments 1 to 11, wherein the perforation pattern comprises a geometric array.

Embodiment 14. The acoustic ceiling panel according to any of embodiments 1 to 13, wherein the porous material includes a fibrous material, such as mineral wool (e.g., glass, slag, or stone), polymer fibers (e.g., PET or polyester), cellulose fibers (e.g., paper, wood pulp or plant fibers), or combinations thereof.

Embodiment 15. The acoustic ceiling panel according to any of embodiments 1 to 14, wherein the porous material includes a porous filler, e.g., perlite.

Embodiment 16. The acoustic ceiling panel according to any of embodiments 1 to 15, wherein the porous material includes a binder, e.g., starch, latex, or phenolic resin.

Embodiment 17. The acoustic ceiling panel according to any of embodiments 1 to 16, wherein the porous material has a density of at least 2 lb/ft$^3$, e.g., at least 6 lb/ft$^3$, e.g., at least 8 lb/ft$^3$, e.g., at least 10 lb/ft$^3$.

Embodiment 18. The acoustic ceiling panel according to any of embodiments 1 to 17, wherein the porous material has a density no greater than 20 lb/ft$^3$, e.g., no greater than 16 lb/ft$^3$, e.g., no greater than 15 lb/ft$^3$.

Embodiment 19. The acoustic ceiling panel according to any of embodiments 1 to 18, wherein the porous material has a porosity of at least 0.25, e.g., at least 0.6, e.g. at least 0.8.

Embodiment 20. The acoustic ceiling panel according to any of embodiments 1 to 19, wherein the acoustic substrate has a thickness of at least ¼ inch, e.g., at least ½ inch, e.g., at least ¾ inch.

Embodiment 21. The acoustic ceiling panel according to any of embodiments 1 to 20, wherein the acoustic substrate has a thickness of no more than 2 inches, e.g., no more than 1.5 inches, e.g., no more than 1 inch.

Embodiment 22. The acoustic ceiling panel according to any of embodiments 1 to 21, wherein the backing layer includes a binder, e.g., acrylic resin.

Embodiment 23. The acoustic ceiling panel according to any of embodiments 1 to 22, wherein the backing layer includes a filler, e.g., calcium carbonate.

Embodiment 26. The acoustic ceiling panel according to any of embodiments 1 to 25, wherein the veil includes a fibrous material, e.g., fiberglass, polyester, or PET.

Embodiment 27. The acoustic ceiling panel according to any of embodiments 1 to 26, wherein the acoustic ceiling panel has a length of at least 12 inches, e.g., at least 18 inches, e.g., at least 24 inches.

Embodiment 28. The acoustic ceiling panel according to any of embodiments 1 to 27, wherein the acoustic ceiling panel has a length of no more than 20 feet, e.g., no more than 10 feet, e.g., no more than 5 feet.

Embodiment 29. The acoustic ceiling panel according to any of embodiments 1 to 28, wherein the acoustic ceiling panel has a width of at least 12 inches, e.g., at least 18 inches, e.g., at least 24 inches.

Embodiment 30. The acoustic ceiling panel according to any of embodiments 1 to 29, wherein the acoustic ceiling panel has a width of no more than 10 feet, e.g., no more than 8 feet, e.g., no more than 4 feet.

Embodiment 31. The acoustic ceiling panel according to any of embodiments 1 to 30, wherein the acoustic ceiling panel is planar.

Embodiment 32. A method of making an acoustic ceiling panel according to any of embodiments 1-31, the method comprising:

adding a plurality of components of the porous material of the acoustic substrate and water to a mixing tank;

mixing the plurality of components and water in the mixing tank so as to form a slurry;

dispensing the slurry onto a support surface;

drying the slurry so as to form a slab of the porous material having a first face and a second face;

forming perforations in the second face of the acoustic substrate;

applying the backing layer over the first face of the acoustic substrate; and applying the veil over the second face of the acoustic substrate.

Embodiment 33. The method according to embodiment 32, wherein a solid percentage of the slurry is at least 2%, e.g., at least 3%, e.g., at least 4%.

Embodiment 34. The method according to embodiment 32 or embodiment 33, wherein a solid percentage of the slurry is no more than 10%, e.g., no more than 8%, e.g., no more than 5%.

Embodiment 35. The method according to any of embodiments 32 to 34, wherein a solid percentage of the water is no more than 0.5 weight %, e.g., no more than 0.3 weight %.

Embodiment 36. The method according to any of embodiments 32 to 35, wherein drying the slurry includes water removal by gravity.

Embodiment 37. The method according to any of embodiments 32 to 36, wherein drying the slurry includes water removal by vacuum suction.

Embodiment 38. The method according to any of embodiments 32 to 37, wherein drying the slurry includes heating the slurry in a dryer.

Embodiment 39. The method according to any of embodiments 32 to 38, wherein the perforations are formed by inserting pins into the second face of the acoustic substrate.

Embodiment 40. The method according to any of embodiments 32 to 39, wherein the backing layer is applied as a coating.

Embodiment 41. An acoustic ceiling system comprising:
a ceiling support structure; and
an acoustic ceiling panel according to any of embodiments 1 to 31 secured to the ceiling support structure.

Embodiment 42. The acoustic ceiling system according to embodiment 41, wherein the ceiling support structure includes a ceiling grid.

Embodiment 43. The acoustic ceiling system according to embodiment 41, wherein the acoustic ceiling panel is hung from the ceiling support structure.

Embodiment 44. The acoustic ceiling system according to any of embodiments 41 to 43, wherein the acoustic ceiling panel is one of an array of acoustic ceiling panels in the acoustic ceiling system.

Embodiment 45. The acoustic ceiling system according to embodiment 44, wherein the acoustic ceiling panels are parallel.

Embodiment 46. The acoustic ceiling system according to embodiment 45, wherein the illuminated acoustic ceiling elements are coplanar.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. An acoustic ceiling panel comprising:
an acoustic substrate formed of a porous material, the porous material comprising in the range of 60-95% on a dry weight basis of a fibrous material and in the range of 1-15% on a dry weight basis of a polymeric binder binding the fibrous material, the porous material having a density no more than 20 lb/ft$^3$, the acoustic substrate having an air flow resistivity of at least 300 kPa*s/m$^2$, the acoustic substrate including:
an upper face, and
a lower face with a pattern of perforations formed therein, the pattern of perforations covering at least 6% of the area of the lower face;
a backing layer disposed over the upper face of the acoustic substrate; and
a veil disposed over the lower face.

2. The acoustic ceiling panel according to claim 1, wherein the air flow resistivity of the porous material is no more than 600 kPa*s/m$^2$.

3. The acoustic ceiling panel according to claim 1, wherein the pattern of perforations covers no more than 25% of the area of the lower face.

4. The acoustic ceiling panel according to claim 1, wherein the acoustic substrate has a noise reduction coefficient (NRC) of at least at least 0.8.

5. The acoustic ceiling panel according to claim 1, wherein the acoustic substrate has a ceiling attenuation class (CAC) of at least 25.

6. The acoustic ceiling panel according to claim 1, wherein the average size of the perforations is at least 0.25 mm and is no more than 5 mm.

7. The acoustic ceiling panel according to claim 1, wherein the average depth of the perforations is at least 40% of the thickness of the acoustic substrate, and is no more than 90% of the thickness of the acoustic substrate.

8. The acoustic ceiling panel according to claim 1, wherein the average depth of the perforations is at least 0.1 inches and is no more than 2 inches.

9. The acoustic ceiling panel according to claim 1, wherein the perforation pattern comprises a randomized pattern.

10. The acoustic ceiling panel according to claim 1, wherein the perforation pattern comprises a geometric array.

11. The acoustic ceiling panel according to claim 1, wherein the a fibrous material is selected from mineral wool, polymer fibers, cellulose fibers, and combinations thereof.

12. The acoustic ceiling panel according to claim 1, wherein the porous material has a density of at least 6 lb/ft$^3$.

13. The acoustic ceiling panel according to claim 1, wherein the porous material has a porosity of at least 0.6.

14. The acoustic ceiling panel according to claim 1, wherein the acoustic substrate has a thickness of at least ¼ inch and of no more than 2 inches.

15. The acoustic ceiling panel according to claim 1, wherein the veil includes a fibrous material.

16. The acoustic ceiling panel according to claim 1, wherein the acoustic ceiling panel has a length of at least 12 inches and no more than 20 feet.

17. The acoustic ceiling panel according to claim 1, wherein the acoustic ceiling panel has a width of at least 12 inches and of no more than 10 feet.

18. A method of making an acoustic ceiling panel according to claim 1, the method comprising:
adding a plurality of components of the porous material of the acoustic substrate and water to a mixing tank;
mixing the plurality of components and water in the mixing tank so as to form a slurry;
dispensing the slurry onto a support surface;
drying the slurry so as to form a slab of the porous material having a first face and a second face;
forming perforations in the second face of the acoustic substrate;
applying the backing layer over the first face of the acoustic substrate; and
applying the veil over the second face of the acoustic substrate.

19. An acoustic ceiling system comprising:
a ceiling support structure; and
an acoustic ceiling panel according to claim 1 secured to the ceiling support structure.

20. The acoustic ceiling system according to claim 19, wherein the acoustic ceiling panel is one of an array of acoustic ceiling panels in the acoustic ceiling system.

21. An acoustic ceiling panel comprising:
an acoustic substrate formed of a porous material, the porous material comprising in the range of 60-95% on a dry weight basis of a fibrous material and in the range of 1-15% on a dry weight basis of a polymeric binder binding the fibrous material, the porous material having a density of at least 6 $lb/ft^3$ and no more than 20 $lb/ft^3$, the acoustic substrate having an air flow resistivity of at least 300 $kPa*s/m^2$, the acoustic substrate including:

an upper face, and a lower face with a pattern of perforations formed therein, the pattern of perforations covering at least 6% and no more than 25% of the area of the lower face, wherein the average depth of the perforations is at least 40% of the thickness of the acoustic substrate, and is no more than 90% of the thickness of the acoustic substrate, and the average size of the perforations is at least 0.25 mm and is no more than 5 mm;

a backing layer disposed over the upper face of the acoustic substrate; and a veil disposed over the lower face.

* * * * *